United States Patent [19]

Mulitz

[11] 4,083,536

[45] Apr. 11, 1978

[54] ADJUSTABLE RAILING

[75] Inventor: Lewis Mulitz, Washington, D.C.

[73] Assignee: Pico Safe Stairs Co., Hyattsville, Md.

[21] Appl. No.: 584,878

[22] Filed: Jun. 9, 1975

[51] Int. Cl.[2] ..... B21F 27/00

[52] U.S. Cl. ..... 256/47

[58] Field of Search ..... 256/59, 64, 21, 22, 256/24, DIG. 5; 403/362, 347; 52/297, 298, 294

[56] References Cited

U.S. PATENT DOCUMENTS

| | | | |
|---|---|---|---|
| 281,717 | 7/1883 | Oliver | 256/DIG. 5 |
| 2,052,600 | 9/1936 | Boss | 403/362 |
| 2,145,172 | 1/1939 | Gustafson | 256/22 |
| 2,780,440 | 2/1957 | Krieger | 256/65 |
| 2,833,522 | 5/1958 | Michaels | 256/65 |
| 3,205,634 | 9/1965 | Wagner | 52/298 |
| 3,314,658 | 4/1967 | Shoemaker | 256/13.1 |
| 3,787,033 | 1/1974 | Snyder et al. | 256/59 |

FOREIGN PATENT DOCUMENTS

| | | | |
|---|---|---|---|
| 1,255,724 | 12/1971 | United Kingdom | 256/59 |

*Primary Examiner*—Doris L. Troutman
*Attorney, Agent, or Firm*—Karl W. Flocks

[57] ABSTRACT

An adjustable railing with vertical members having holes or a groove therethrough to receive horizontal rails which are adjusted in the field and fastened mechanically or by minor welding. The vertical members may also be vertically adjustable in the field.

9 Claims, 6 Drawing Figures

ADJUSTABLE RAILING

BACKGROUND OF THE INVENTION

The present invention relates to railings for use both in residential and commercial construction and more particularly relates to railings which can be adjusted in the field.

Railings must be made to conform to the tolerance allowances in the materials to which it attaches, which requires custom fabrication except if adjustments to these tolerances can be made in the field in a simple and economical manner while also preserving high aesthetic qualities.

SUMMARY OF THE INVENTION

The adjustable railing of the present invention provides a safe, economical railing with aesthetic qualities high enough to make possible its use in both residential and commercial construction.

It is also an object of the present invention to use a minimum of different types of materials to make handling of material procurement and identification required for assembly of the railing very easy and thus less costly.

It is a further object of the present invention to have a railing which can be field adjusted to compensate for the ever increasing tolerance allowances in the materials to which it attaches whereby expensive field vertification of dimensions and expensive custom fabrication can be avoided, and to compensate for the myriad of interferences in the building construction.

An advantage of the present invention is that it allows assembly of railings in the field for almost equal the costs of assembly in the shop.

Basically, vertical members having holes therethrough receive horizontal members which are adjustable in the holes and held by mechanical fasteners or minor welding.

Also with the present invention, the vertical members are also adjustable in holders and held by mechanical fasteners or screws.

BRIEF DESCRIPTION OF THE DRAWINGS

The invention will now be described in detail in connection with the accompanying drawings in which.

DESCRIPTION OF THE PREFERRED EMBODIMENTS

Figure 1:
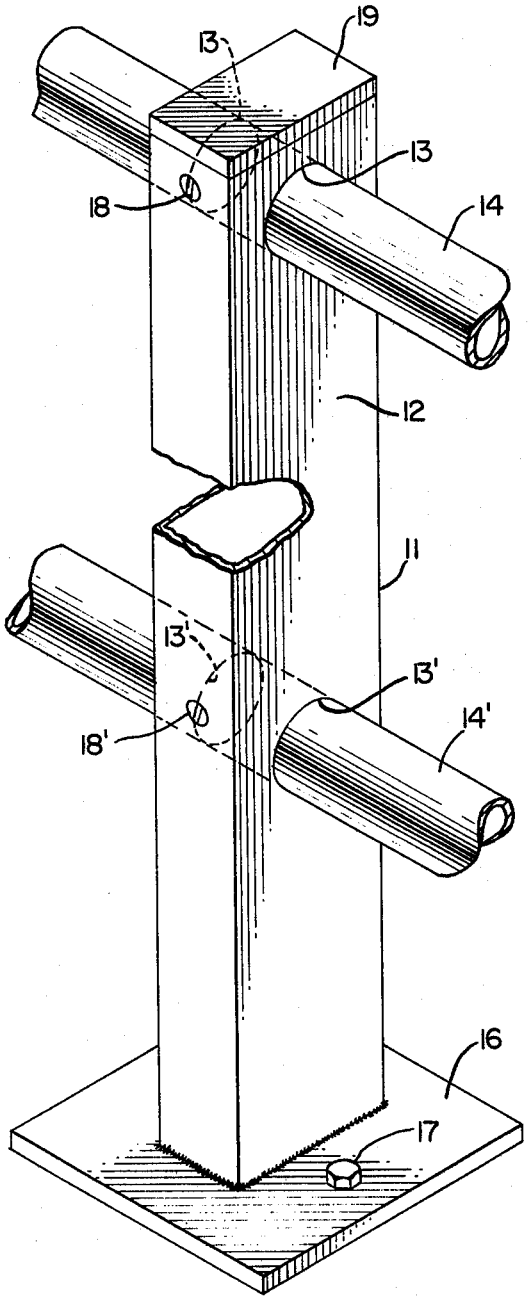
FIG. 1 is a perspective view of a portion of the railing of the present invention at one of the upright posts.
Figure 2:
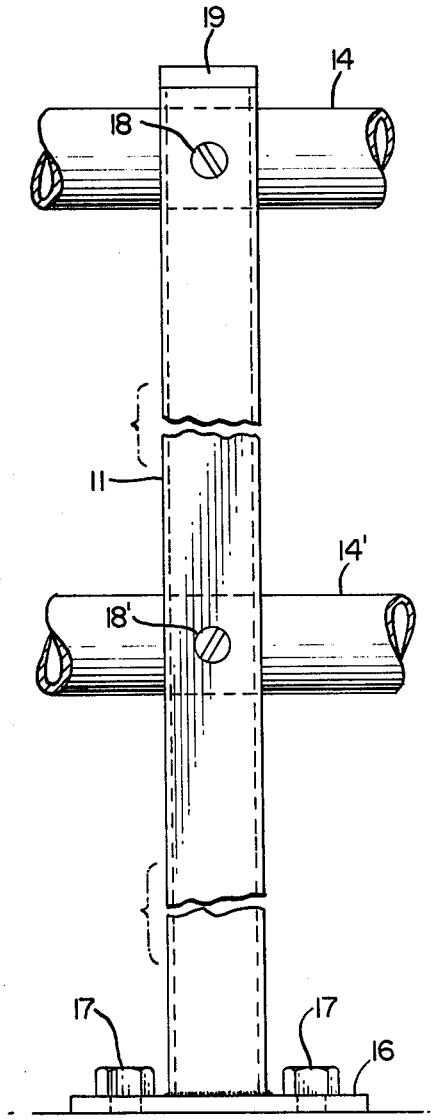
FIG. 2 is a side elevation view of the portion of the railing shown in FIG. 1.

Referring first to FIGS. 1 and 2 there are shown in those views a form of the adjustable railing of the present invention. An upright post or vertical member 11, which is one of a plurality of such members spaced along the extent of the railing, is of any type of commercially available material, metal or otherwise, having a surface 12 of sufficient dimensions to permit drilling, punching, or stamping of holes 13, 13' of a size to permit the insertion and passing of upper rail or horizontal member 14 and lower rail or horizontal member 14' through holes 13 and 13', respectively.

Vertical member 11 is mounted by welding or similar means to base 16 which base is attached to a concrete or wood deck by bolts 17. Adjustment of the railings for variation in distances between vertical members 11 is made by movement of horizontal members 14,14' in holes 13,13'. After such adjustment, mechanical fasteners 18,18' which may be set screws as shown, or alternatively by minor welding, the horizontal members 14,14' are locked in position in relation to vertical members 11.

A top cap 19 is used when vertical member 11 is hollow as shown in FIGS. 1 and 2 to furnish a finished appearance to each of the vertical members 11 and allow for a more aesthetically pleasing railing.

Figure 3:
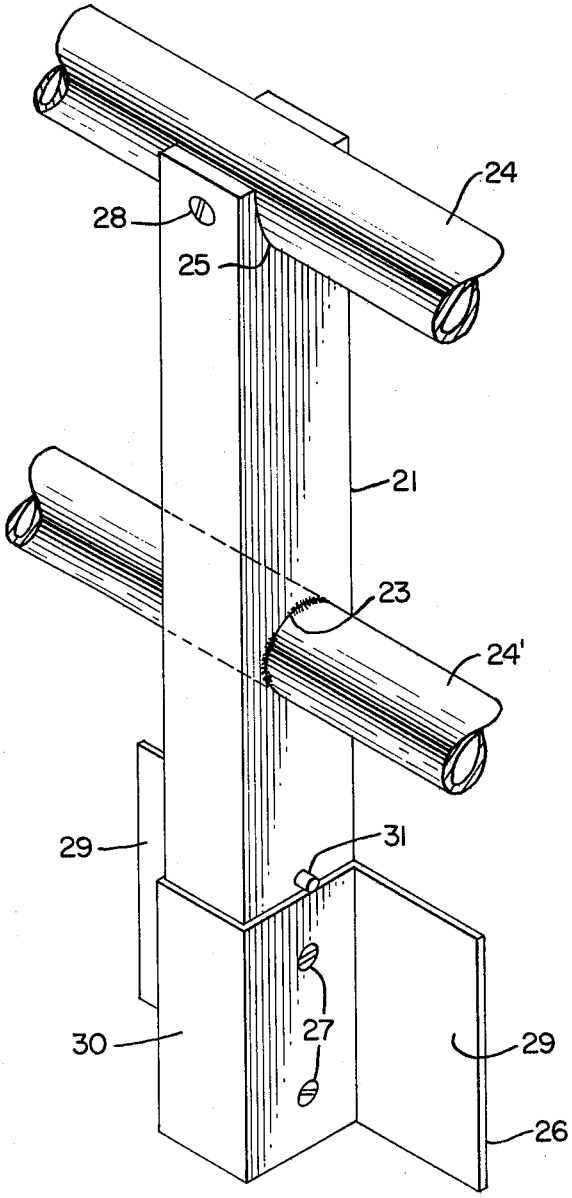
FIG. 3 is a perspective view of other embodiments of the present invention.

FIG. 3 discloses another embodiment of the present invention with an upright post or vertical member 21 in which is drilled, punched, or stamped, a hole 23 to receive a lower rail or horizontal member 24' therethrough. In the top of vertical member 21 there is a groove 25 of a V shape so as to receive upper rail or horizontal member 24 resting therein. After upper horizontal member 24 has been rested in U shaped groove 25 and lower horizontal member 24' passed through holes 23 in spaced vertical members 21 and adjusted for variance in distances between members 21, mechanical fasteners 28 such as a set screw shown, or by minor welding shown in connection with horizontal member 24' are tightened to lock horizontal members 24,24' in position in relation to vertical members 21.

In this embodiment base section 26 is a bent sheet section positioned so that wing sections 29 may be attached to the side over the edge of a platform or in fact sections 29 could be extended to act as a side wall by itself. The three-sided rectangular shaped base 30 is shaped to receive the bottom portion of vertical member 21 therein. If vertical member 21 is to remain removable and to limit the depth that member 21 extends into base 30, and also to control the height of member 21 and add further support against the downward forces thereon a dowel 31 extending from the side of vertical member 21 may be used. In addition, fasteners 27, which may be set screws as shown, are used to lock the vertical member 21 in position in base 30 after any necessary vertical adjustment has been completed.

It should be noted that although minor welding may be used in place of the mechanical fasteners shown, the mechanical fasteners 18,18',28, and 27 allow further adjustment and disassembly of the railing if necessary after the initial installation, and if such mechanical fasteners are used throughout without any welding.

Figure 4:
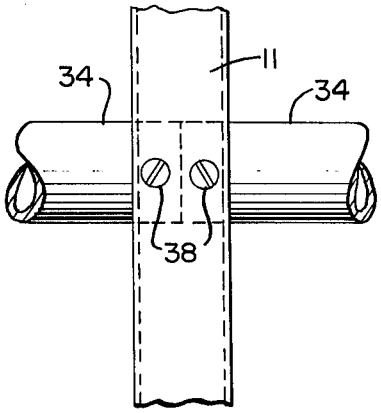
FIG. 4 is a partial elevational view with rail ends meeting in an upright post.

At some point along the railing a horizontal member such as horizontal members 34 in FIG. 4 is ended, but the railing continues. This can be done in an upright post with the two ends 34 inserted in a post, not necessarily abutting, and held in place by mechanical features 38.

Figure 5:
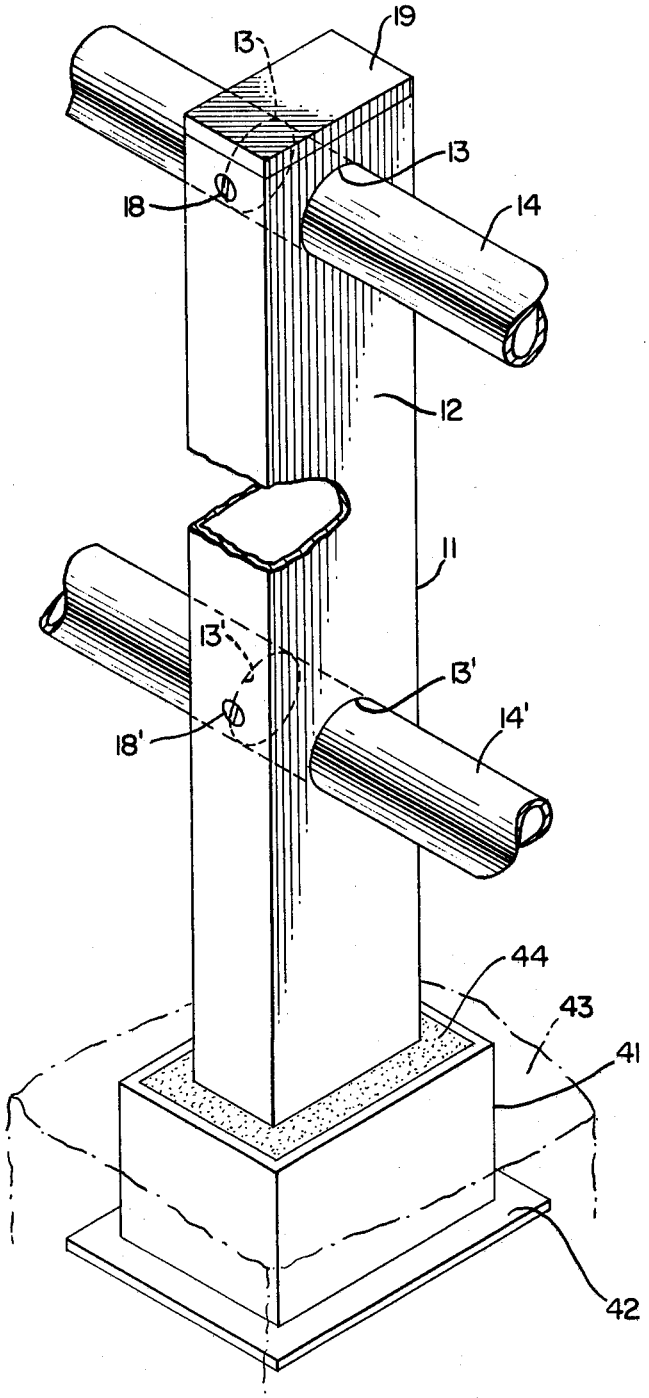
FIG. 5 is a perspective view of a portion of the railing as shown in FIG. 1 but supported in a different manner.
Figure 6:
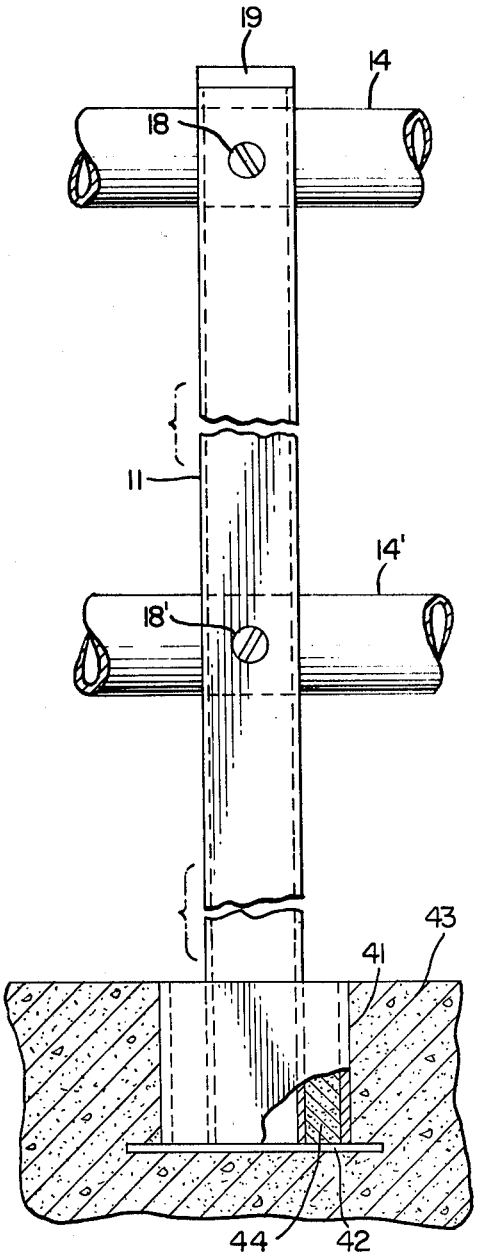
FIG. 6 is a side elevational view of the portion of the railing shown in FIG. 5.

FIGS. 5 and 6 show the vertical member 11 with upper rail 14 and rail 14' connected and interfitting as in FIGS. 1 and 2. In this case, instead of supporting vertical member 11 by welding or attachment by other means to base 16, vertical member 11 is supported by standing it in a sleeve 41 with a flanged base 42 which is set in concrete 43. The flange aids in resisting a force which might work to loosen and pull out sleeve 41 from concrete 43. Inside sleeve 41 the space between the lower end of vertical member 11 and the inner walls of sleeve 41 is filled with grout or a concrete mixture 44 until it is even with the top of sleeve 41 and the upper surface of concrete 43 and thus forms a support for vertical member 11.

It will be obvious to those skilled in the art that various changes may be made without departing from the scope of the invention and the invention is not to be considered limited to what is shown in the drawings and described in the specification.

What is claimed is:

1. An adjustable railing comprising a plurality of vertical members each having a rectangularly dimensioned horizontal cross section formed by its vertical sides and at least one circular hole therethrough along its vertical length and passing through the vertical sides which form the longer dimensions of said rectangular cross section, a tubular horizontal member slidingly extending through each said at least one hole in said vertical members and between said vertical members, means to lock said vertical member and said horizontal member passing therethrough to each other without substantially changing the outlines of said vertical member and said horizontal member at their points of intersection.

2. The adjustable railing of claim 1, further characterized by said locking means including a set screw extending into said vertical member through a said vertical side which forms a shorter dimension of said rectangular cross section and against said horizontal member.

3. The adjustable railing of claim 1, further characterized by said locking means being minor welding of said vertical member and said horizontal member to each other.

4. The adjustable railing of claim 1, further characterized by said vertical member having a U shaped groove on its upper end, an upper horizontal member resting in said U shaped groove, and means to lock said upper horizontal member in said U shaped groove.

5. The adjustable railing of claim 4, further characterized by said locking means being set screws extending into said vertical member through said vertical side which forms a shorter dimension of said rectangular cross section and against said horizontal members.

6. The adjustable railing of claim 1, further characterized by a base portion shaped to slidingly receive the lower portion of said vertical member in a telescoping connection, and fastening means to lock said vertical member to said base portion, a projection means from said vertical member extending over said base portion to limit the vertical movement of said vertical member into said base portion and support said vertical member on said base portion.

7. The adjustable railing of claim 6, further characterized by said base portion having a U-shape with the side of the U extending horizontally, extensions extending at substantially right angles from said sides of the U adapted for attachment to supporting structure to support said vertical member.

8. The adjustable railing of claim 1, further characterized by a base portion shaped to slidingly receive the lower portion of said vertical member in a telescoping connection, said base portion being a sleeve set into concrete and having a flange below the surface of the concrete extending from its vertical walls, and means to hold said vertical member to said base portion.

9. The adjustable railing of claim 8, further characterized by said holding means being concrete-like material within said sleeve between the lower portion of said vertical member and the inner walls of said sleeve.

* * * * *